United States Patent [19]

Drobnik

[11] 4,022,708

[45] May 10, 1977

[54] METHOD OF PREPARATION FOR STORAGE OF LIQUIDS USED IN THE REPROCESSING OF SPENT NUCLEAR FISSILE AND/OR FERTILE MATERIALS

[75] Inventor: Stefan Drobnik, Blankenloch, Germany

[73] Assignee: Gesellschaft fur Kernforschung m.b.H., Karlsruhe, Germany

[22] Filed: July 31, 1973

[21] Appl. No.: 384,172

[30] Foreign Application Priority Data

Aug. 5, 1972 Germany ..... 2238694

[52] U.S. Cl. ..... 252/301.1 W; 210/21; 210/22 R; 210/59; 210/60; 252/301.1 R; 423/8; 423/10

[51] Int. Cl.² ..... G21F 9/20; G21F 9/24

[58] Field of Search ..... 252/301.1 W, 301.1 R; 423/10, 8; 210/21, 22 R, 59, 60

[56] References Cited

UNITED STATES PATENTS

| | | | |
|---|---|---|---|
| 2,859,092 | 11/1958 | Bailes et al. | 423/10 |
| 2,859,094 | 11/1958 | Schmitt et al. | 423/10 |
| 2,860,031 | 11/1958 | Grinstead | 423/10 |
| 2,882,123 | 4/1959 | Long | 423/10 |
| 2,885,260 | 5/1959 | Maraman et al. | 423/10 |
| 2,924,506 | 2/1960 | Anderson et al. | 423/10 |
| 3,006,859 | 10/1961 | Allemann et al. | 252/301.1 W |
| 3,052,514 | 9/1962 | Schmitt | 423/10 |
| 3,154,500 | 10/1964 | Jansen, Jr. et al. | 252/301.1 W |
| 3,666,673 | 5/1972 | Knoll | 252/301.1 W |
| 3,708,508 | 1/1973 | Schulz | 252/301.1 W |
| 3,825,649 | 7/1974 | Gresky et al. | 423/10 |

FOREIGN PATENTS OR APPLICATIONS

| | | | |
|---|---|---|---|
| 1,520,681 | 4/1968 | France | 252/301.1 W |
| 1,614,173 | 3/1970 | Germany | 252/301.1 W |
| 1,464,476 | 3/1969 | Germany | 252/301.1 W |

OTHER PUBLICATIONS

"Semiannual Report of the Chemistry Department, Nov. 1965—May 1966", (Commissariat a l'Energie Atomique, Fontenay-Aux-Roses [France] Centre d'Etudes Nucleaires), pp. 199–214, (Dec. 1966).

"Reaktortagung", Drobnik, S. et al., pp. 264–266 (Apr. 1972) (Ger).

C.A., vol. 78, 7561 c (Jan.–June 1973)–Abst Of "Reaktortagung", pp. 264–266 (1972) Ger. Drobnik, S. et al.

*Primary Examiner*—Richard D. Lovering
*Assistant Examiner*—T. S. Gron
*Attorney, Agent, or Firm*—Spencer & Kaye

[57] ABSTRACT

A method of preparation for non-polluting storage of liquids containing phosphoric acid ester and hydrocarbons used in the reprocessing of spent nuclear fissile and/or fertile materials. The hydrocarbons are recycled for the production of fresh phosphoric ester-hydrocarbon solutions and the residue is brought into a form which can be fixed.

27 Claims, No Drawings

METHOD OF PREPARATION FOR STORAGE OF LIQUIDS USED IN THE REPROCESSING OF SPENT NUCLEAR FISSILE AND/OR FERTILE MATERIALS

The present invention relates to a method of preparation for non-polluting storage of liquids used in the reprocessing of spent nuclear fissile and/or fertile materials containing phosphoric acid esters and hydrocarbons.

Spent nuclear fissile and/or fertile materials are mostly dissolved in nitric acid at the beginning of their reprocessing. Valuable materials such as uranium or plutonium or, in smaller quantities, the nuclides contained in the solutions, such as neptunium or transplutonium elements, are recovered from such solutions by extraction with phosphoric acid esters. The phosphoric acid esters are dissolved in hydrocarbons and diluted with the latter, respectively, and undergo radiolytic and chemical decomposition, especially in the presence of nuclear fissile and/or fertile materials with high burn-ups, as a consequence of the strong ionizing radiation emitted by fission nuclides, plutonium etc. and due to the contact with nitric acid. This gives rise to decomposition products such as partly esterified acids, esters of nitric acid and of nitrous acid, nitro-compounds and others, some of which generate very stable complexes greatly upsetting the separation processes during extraction, especially with such fission products as ruthenium, zirconium, niobium, but also with such valuable materials as uranium and plutonium.

If the solvent used in extraction, mostly 20 to 30 vol. % of phosphoric acid ester dissolved in 80 to 70 vol. % of n-alkane is washed in a soda solution, only part of the decomposition products generated will be removed and only an insufficient decontamination effect will be generated. For this reason, the solvent is discarded as waste at regular intervals once a disturbing degree of decomposition has been reached.

In order to remove small quantities, for instance traces, of phosphoric acid esters from aqueous phases which have been separated from the organic phases after extraction processes, these aqueous phases are washed with hydrocarbons. The contaminated washing and cleaning liquids this produces are also discarded as waste.

So far, these organic liquids, some of which contain radioactive fission products of relatively high activity, e.g. 1 Ci/m$^3$ or more, have been removed by various processes which, however, either are characterized by major technical disadvantages, generate high costs or are not feasible with respect to the protection to the environment. A few examples of these methods of removal will be outlined below.

Discharge into the soil:

Only some of the radioactive materials are retained by materials in the soil; most of them seep through the layers of the soil together with the organic liquid and penetrate perhaps right into the groundwater.

Tank storage:

This method does not lend itself to a storage over prolonged periods of time and/or large volumes of waste. The acids or acid decomposition products of the contents of the liquids produced by radiolysis and hydrolysis increasingly corrode the tanks as time goes on. Moreover, easily flammable radiolysis gases such as hydrogen, methane, etc. are produced.

Distillation:

If organic waste liquids are subjected to a water vapor distillation, only low values of the efficiency of decontamination (decontamination factors or DF-values) will be achieved: the distillate contains approximately 3% of the radioactive materials, $$DF = \frac{\text{radioactivity of the liquid to be decontaminated}}{\text{radioactivity of the distillate}} = \text{approx. } 33.$$

If better DF-values are to be achieved, a radioactive residue of approximately 10 vol. % must be anticipated. In addition, the water of condensation contains radioactive substances.

DF-values between 10 and a few hundred are achieved by means of vacuum distillation which, however, requires expensive and complicated facilities. Distillation is performed under a vacuum ranging between 0.5 and 15 Torr and at a temperature above 100° C. Some of the phosphoric acid ester is thermally decomposed in the process. This method can be used to recover between 90 and almost 100% of the hydrocarbons introduced together with waste liquid and some 60 to 80% of the phosphoric acid ester.

Distillation under normal conditions, i.e., at normal pressure and a temperature of approx. 135° C gives rise to an explosion-like decomposition as a consequence of the reaction between nitrates and phosphoric acid ester, e.g., TBP in the liquid.

Combustion:

If organic waste liquids containing phosphoric acid esters are burned, this generates strongly corrosive gases carrying with them radioactive substances and phosphoruspentoxide as aerosols. The usual filters for gases containing radioactive materials will be plugged up within a very short time, will be corroded and thus be rendered useless. Hence, the combustion or flue gases must first of all be scrubbed and the phosphoruspentoxide must be neutralized before there can be final filtration.

The disadvantages associated with the methods of removal listed above entail hazards, such as the penetration of radioactive substances into the biocycle, the penetration of organic liquids into the groundwater, the generation of highly flammable gases, explosions in distillation plants etc.

The present invention is based on the objective of creating a process safely avoiding the disadvantages and hazards accompanying previous practices of removing radioactive liquids containing phosphoric acid esters and hydrocarbons. At the same time, a maximum volume reduction is to be ensured by the method in order to meet the requirements of environmental protection and minimize the total cost associated with the waste storage of reprocessing plants. Both highly contaminated waste solutions and weakly or hardly contaminated solutions, such as washing and cleaning liquids, are to be prepared for non-polluting secular storage in a rapid, harmless and simple way.

The problem is solved in an advantageous way by recycling the hydrocarbons for the production of fresh phosphoric acid ester-hydrocarbon solutions and reducing the residue to a form which can be fixed. This implies that immediately following upon the method according to the present invention the familiar decontamination and solidification processes and combustion and filtration processes, respectively, known for the treatment of aqueous waste solutions and flammable gaseous or liquid wastes and the devices for further conditioning of the products generated by the method according to the invention can be used, such as further volume reduction of aqueous solutions into concentrates and introduction of these concentrates into solidification matrices.

For this purpose, phosphoric acid ester-hydrocarbon waste liquids from extraction and/or re-extraction cycles and containing at least one contamination of the groups radioactive materials, decomposition and/or hydrolysis products of phosphoric acid esters, nitric acid esters, nitrous acid esters, nitro-compounds and complex compounds of at least one of these compounds with ruthenium, zirconium, niobium, uranium or plutonium are treated with aqueous solutions of inorganic compounds for separation of the hydrocarbons from the phosphoric acid esters and impurities.

Extraction and/or re-extraction cycles are such processes or steps of processes as are employed to reprocess spent nuclear fissile and/or fertile materials.

In another embodiment of the method according to the present invention hydrocarbon washing and cleaning liquids used for washing and cleaning aqueous re-extraction phases of phosphoric acid esters are treated with aqueous solutions of inorganic compounds for separation of the hydrocarbons from the phosphoric acid esters. The aqueous solution of an inorganic compound used is concentrated phosphoric acid or approximately 50% of caustic soda solution. For the separation of hydrocarbons from phosphoric acid ester-hydrocarbon waste liquids (process flowsheet 1) concentrated phosphoric acid is added at room temperature in a quantity corresponding to a molar ratio of $H_3PO_4$ relative to phosphoric acid ester of 2:1 referred to the phosphoric acid ester content of the waste liquid; the two phases generated, one lighter phase containing the hydrocarbons and one heavier phase containing the phosphoric acid and impurities, are separated from each other. Afterwards, the heavier phase is treated with an excess of water determined in accordance with its volume and the two phases generated in this way, one lighter phase containing phosphoric acid ester and a small fraction of radioactive impurities, and a heavier phase containing diluted phosphoric acid and the residual fraction of impurities, are separated from each other. Afterwards, the lighter phase containing phosphoric acid ester is saponified by adding a base. The addition of concentrated phosphoric acid to the waste liquid results in the generation of adduct compounds between phosphoric acid esters and $H_3PO_4$ which are present in the heavier phase containing phophoric acid and impurities after generation of the two phases. The addition of water reverses the adduct formation. Saponification is best performed at a temperature at which a separation of the saponification products occurs. One saponification product is removed. In one embodiment of the method according to the present invention the phase containing phosphoric acid ester consists of tributyl phosphate (TBP), saponification is performed at a temperature in excess of 90° C, the saponification product removed is an azeotropic mixture of butanol and water, and this mixture is cooled to room temperature. The two phases generated after cooling of the azeotropic mixture are separated from each other; the organic phase essentially consisting of butanol is burnt, the aqueous phase generated is recycled into the saponification process.

In a different embodiment of the method according to the present invention the phase containing phosphoric acid ester consists of di-(2-ethyl-hexyl)- phosphoric acid (HDEHP), saponification is performed at a temperature in the excess of 90° C, the saponification product removed is an azeotropic mixture of 2-ethyl-hexanol-(1) and water, which mixture is cooled to room temperature. The two phases generated after cooling of the azeotropic mixture are separated from each other, the organic phase generated essentially consisting of 2-ethyl-hexanol-(1) is burnt, the aqueous phase generated is recycled into the saponification process. In another embodiment of the method according to the present invention the phase containing phosphoric acid ester consists of a mixture of TBP and HDEHP, saponification is performed at a temperature in excess of 90° C, the saponification product removed is a mixture of butanol, 2-ethyl-hexanol-(1) and water, which mixture is cooled to room temperature. The two phases generated after cooling of the mixture of butanol, 2-ethyl-hexanol-(1) and water are separated from each other, the organic phase generated essentially consists of butanol and 2-ethyl-hexanol-(1) and is burnt, the aqueous phase generated is recycled into the saponification process.

It is preferable if the excess of water, with which the heavier phase containing phosphoric acid and impurities is treated after separation of the lighter phase containing hydrocarbons, corresponds to between two and five times the volume of the heavier phase containing phosphoric acid and impurities and if the base used for saponification of the lighter phase containing phosphoric acid ester after decomposition of the adduct is approx. 50% caustic soda solution.

In a preferred embodiment the lighter phase containing hydrocarbons generated after the addition of phosphoric acid to the waste liquid is treated first with an aqueous washing solution and afterwards with active charcoal and then re-used to prepare fresh solutions of phosphoric acid ester and hydrocarbons. The washing solution used is a sodium oxalate solution with a $p_H$ between 10 and 11.

For separating the hydrocarbons from the phosphoric acid esters in waste liquids or in hydrocarbon washing and cleaning liquids, respectively (process flowsheet 2) used for washing and cleaning the aqueous re-extraction phases of phosphoric acid esters approximately 50% caustic soda solution is added in a quantity corresponding to a molar ratio of NaOH to phosphoric acid ester of 3:1, referred to the phosphoric acid ester content of the liquid, the reaction mixture is heated to a temperature at which phosphoric acid ester and saponifiable impurities are saponified and the saponification products are separated from each other. During the process of saponification one saponification product is continuously removed, recondensed and cooled. In one embodiment of the method according to the present invention the phosphoric acid ester to be saponified consists of TBP, the saponification product removed is an azeotropic mixture of butanol and water, the two phases produced as the mixture cools are separated from each other, the organic phase mainly consists of butanol and is burnt, and the aqueous phase generated is returned to the saponification process. In another embodiment of the method according to the present invention the phosphoric acid ester to be saponified consists of HDEHP, the saponification product removed is an azeotropic mixture of 2-ethylhexanol-(1) and water, the two phases produced as the mixture cooled are separated from each other, the organic phase consists mainly of 2-ethylhexanol-(1) and is burnt, and the aqueous phase generated is returned to the saponification process. In another embodiment of the method according to the present invention the phosphoric acid ester to be saponified consists of a mixture of TBP and HDEHP, the saponification product removed is a mixture of butanol, 2-ethylhexanol-(1) and water, the two phases generated during cooling of the mixture are separated from each other, the organic phase consists mainly of butanol and 2-ethylhexanol-(1) and is burnt, and the aqueous phase produced is returned to the saponification process.

The residue remaining after the end of the saponification process and after complete removal of the volatile saponification products in the saponification vessel is called the reaction mixture. It is advantageous to dilute the reaction mixture with water after saponification and cool it. The two phases of the reaction mixture produced by dilution and cooling, one organic phase containing hydrocarbons and one aqueous phase containing impurities and phosphates, are separated from each other, the phase containing hydrocarbons is washed with concentrated phosphoric acid for cleaning and afterwards re-used for the preparation of fresh phosphoric acid ester-hydrocarbon solution.

In an extension of the method according to the present invention at least the aqueous phase containing diluted phosphoric acid and the main and residual fractions, respectively, of the radioactive impurities (that is the heavier phase after decomposition of the adduct compound) and the aqueous phase containing impurities and phosphates are solidified with bitumen after saponification, while all the other aqueous phases are carried to the waste water decontamination station and from here to the solidification step with bitumen or cement.

In an explanation of the method according to the present invention and in order to highlight the advantages of this method as against previous methods for the removal of the organic radioactive liquids mentioned above, the process steps needed for preparation of the waste liquids for storage will be summarized below in two flowsheets, process flowsheet 1 starting with the admixture of the concentrated phosphoric acid, process flowsheet 2 starting with the saponification of the phosphoric acid esters and the saponifiable impurities in the waste or washing and cleaning liquids, respectively. Process flowsheet 1 in addition includes one example mentioning the quantitative and radioactivity data of a waste liquid prepared for storage according to the method embodied in the present invention and containing TBP and kerosene. However, the validity of the process flowsheet is in no way limited to this example. The flowsheet also refers to other examples in which both other waste liquids with different phosphoric acid esters and/or different hydrocarbons and other quantities of liquid and/or radioactivity are prepared for storage. In addition, one example of an embodiment is included in process flowsheet 2 which likewise does not imply any limitation.

Process flowsheet 1

Step 1: Waste liquid is mixed with concentrated phosphoric acid, the phases generated are separated from each other into one lighter phase (phase 1 L) and one heavier phase (phase 1 S);

for instance: 1 $m^3$ of a liquid consisting of 5 vol. % TBP and 95 vol. % kerosene and radioactive impurities of 1 Curie (1 Ci) is mixed with 42.25 kg (corresponding to 24.7 Ltr. of 85% $H_3PO_4$. This generates approx. 950 Ltr. of phase 1 L with a phosphorus content of less than 1 mg/Ltr. and a radioactivity of $10^{116}$ $^3Ci/m^3$ and approx. 75 Ltr. of phase 1 S with the adduct compound TBP. 2 $H_3PO_4$ and a radioactivity of approx. 1 Ci.

Step 2: For decomposition of the adduct compound phase 1 S is treated with an excess of water, the phases produced are separated from each other into a lighter phase (phase 2 L) and a heavier phase (phase 2 S);

for instance: Approx. 75 Ltr. of phase 1 S and 150 Ltr. of water generate 175 Ltr. of phase 2 S consisting of diluted phosphoric acid with a radioactivity of approx. 0.85 Ci which is supplied to the waste water decontamination plant and from there to solidification with bitumen, and approx. 50 Ltr. of phase 2 L of TBP which contains approx. 0.05 mole $H_3PO_4$ and a radioactivity of approx. 0.15 Ci.

Step 3: Phase 2 L is saponified; a mixture which is azeotropic at the temperature of saponification is distilled off, collected in the receiver and cooled. Two phases occur, a lighter phase (phase 3 L) which is burst and a heavier phase (phase 3 S) which is returned to the saponification process;

for instance: 44 kg of 50% caustic soda solution are added to the approx. 50 Ltr. of phase 2 L and saponified for 6 to 7 hours at approx. 120° C. At this temperature approx. 50Ltr. of azeotropic butanol/water with a radioactivity of approx. $10^{-4}Ci/m^3$ will be produced by distillation. The aqueous residue remaining in the saponification vessel after the period of saponification is cooled to room temperature, diluted with approx. 50Ltr. of water to avoid phosphate precipitation, and solidified into a block in bitumen in the well-known way. The solidification product of the quantities mentioned here has a volume of 53 Ltr. and a radioactivity of 0.03 Ci/Ltr. The solidification products introduced into drums in a molten condition are ready for non-polluting storage. The aqueous distillate escaping in the solidification with bitumen is taken to the waste water decontamination system where part of it is recycled for solidification.

Step 4: Phase 1 L is washed and cleaned and re-used afterwards.

for instance: The approx. 950 Ltr. of Phase 1 L are mixed with approx. 50 Ltr. of 0.1 molar sodium oxalate solution of a $p_H$ of 10 to 11 and washed, the two phases generated are separated from each other into one heavier phase (phase 4 S) consisting of a sodium oxalate solution, which is taken to the waste water decontamination system, and a lighter phase (phase 4 L) consisting of kerosene with a radioactivity of approx. $10^{-4}Ci/m^3$, which is run through an active charcoal filter. Afterwards approx. 950 Ltr. of kerosene are obtained with a radioactivity of $10^{-5}Ci/m^3$ to $10^{-6}Ci/m^3$ which are used for the production of fresh TBP-kerosene solutions.

Process flowsheet 2

Step 1: Waste or washing and cleaning liquids, respectively, are treated with an aqueous solution of a base and phosphoric acid ester and saponifiable impurities are saponified at elevated temperatures; a mixture which is azeotropic at the saponification temperature is distilled off, collected and cooled. Two phases are generated, one lighter phase (phase 5 L), which is burnt, and a heavier phase (phase 5 S), which is recycled to the process of saponification;

for instance: A waste liquid containing 1 $m^3$ of TBP with a radioactivity of approx. 1 Ci is added 8.8 kg of 50% caustic soda solution per vol. % of TBP, referred to the TBP content of the liquid, and saponified for 7 hours at a temperature between 120° and 135° C. During that time 12Ltr. per vol. % of TBP in the waste liquid before saponification is obtained as distillate. The distillate essentially consists of azeotropic butanol/water with minor quantities of hydrocarbons (< 40% of the quantity distilled) and has a phosphorus content of approx. 0.01 mg/Ltr.and a radioactivity of $10^{-5}$Ci/$m^3$ to $10^{-4}$Ci/$m^3$.

Step 2: After cooling of the reaction mixture, that is the liquid residue in the saponification vessel after the period of saponification, this is treated with an excess of water and the two phases are separated from each other into one organic phase containing hydrocarbons (phase 6 L) and one aqueous phase containing the impurities and phosphates (phase 6 S);

for instance: 1100Ltr. of water are added to the reaction mixture remaining in the saponification vessel after step 1. This results in the bulk of hydrocarbons, which is the amount of hydrocarbons originally contained in the waste liquid minus the small quantity of hydrocarbons removed with the saponification product, with a phosphorus content of 0.1 mg/Ltr. and a radio activity of approx. $10^{-4}$Ci/$m^3$ (phase 6 L) and a volume of approx. 1300Ltr.of aqueous phase (phase 6 S) with a dry residue of 220 g/Ltr.

Step 3: Phase 6 S is solidified;

for instance: The 1300 Ltr. of phase 6 S are introduced into molten bitumen at a temperature of 150° C and solidified. This generates 11 Ltr. of solidification product per vol. % of TBP in the waste liquid before saponification and an aqueous distillate which is taken to the waste water decontamination system. The solidification product contains about 40 wt. % of salts and has a density of approx. 1.5 g/$cm^3$. Almost all the radioactive materials originally contained in the quantity of waste liquid are solidified in it. After filling in drums of the liquid solidification products the products can be taken to non-polluting storage.

Step 4: Phase 6 L is washed with concentrated phosphoric acid for purification and afterwards re-used for the fabrication of fresh phosphoric acid ester-hydrocarbon solutions;

for instance: Phase 6 L is washed with 10 Ltr. of 85% phosphoric acid, afterward the two phases are separated. The phosphoric acid is taken to the waste water decontamination system and to solidification with bitumen, respectively; after purification the hydrocarbon phase has a residual radioactivity of only approx. $10^{-6}$Ci/$m^3$ and is re-used in the cycle for reprocessing solutions.

According to process flowsheet 1 almost 100% (more than 99%) of the hydrocarbons are recovered with a decontamination factor $10^6$. The volume reduction relative to the waste liquid prepared for storage is about 20%.

According to process flowsheet 2 some 70–80% of the hydrocarbons are recovered. The decontamination factor of the hydrocarbons is also $10^6$. The volume reduction of waste is approximately the same as in flowsheet 1.

What we claim is:

1. Method of preparing a waste liquid for non-polluting storage and recovering a useful component from the waste liquid, the waste liquid containing a solution of phosphoric acid ester and hydrocarbon used in the reprocessing of spent nuclear fissile and/or fertile materials and further containing at least one impurity in the form of radioactive materials or decomposition products, comprising:

a. adding concentrated phosphoric acid to the waste liquid at room temperature in a quantity corresponding to a molar ratio of $H_3PO_4$ to phosphoric acid ester of 2:1, relative to the phosphoric acid ester content of the waste liquid, to form a lighter phase containing hydrocarbon and a heavier phase containing the phosphoric acid and impurity;

b. separating the heavier phase containing the phosphoric acid and impurity from the lighter phase containing hydrocarbon;

c. washing the lighter phase containing hydrocarbon with an aqueous sodium oxalate washing solution;

d. treating the washed lighter phase with active charcoal to obtain a decontamination factor for the treated washed lighter phase of about $10^5$ to $10^6$ with respect to the waste liquid of step (a);

e. recycling the hydrocarbon obtained in step (d) by adding phosphoric acid ester to the hydrocarbon to form a fresh solution of hydrocarbon and phosphoric acid ester to be used in the reprocessing; and f. treating the separated heavier phase of step (b) containing the phosphoric acid ester and impurity to form a solidified waste product containing radioactive material.

2. The method as claimed in claim 1 wherein step (f) comprises:

g. first treating the separated heavier phase of step (b) containing the phosphoric acid and impurity with an excess of water relative to its volume to form a lighter phase containing phosphoric acid ester and a minor fraction of radioactive impurity and a heavier phase containing diluted phosphoric acid and the residual fraction of the impurity;

h. separating the two phases formed in step (g); and i. saponifying the separated lighter phase of step (h) containing phosphoric acid ester by adding a base to form saponification products.

3. Method as claimed in claim 2 wherein one saponification product is an azeotropic mixture which is removed from the saponified lighter phase.

4. Method as claimed in claim 3 wherein the phosphoric acid ester in the waste liquid is tributyl phosphate (TBP), and the tributyl phosphate is contained in the lighter phase formed in step (g), the saponification is carried out at a temperature in excess of 90° C, and the saponification product removed is an azeotropic mixture of butanol and water and is cooled to room temperature to form an organic phase and an aqueous phase.

5. Method as claimed in claim 4 wherein the two phases generated after cooling off the azeotropic mixture are separated from each other, the organic phase generated from the cooled azeotropic mixture consists mainly of butanol and is burnt, and the aqueous phase generated from the cooled azeotropic mixture is recycled into the saponification process.

6. Method as claimed in claim 3 wherein the phosphoric acid ester in the waste liquid is di-(2-ethylhexyl) - phosphoric acid (HDEHP) and the di-(2-ethylhexyl)phosphoric acid is contained in the lighter phase formed in step (g), the saponification is performed at a temperature in excess of 90° C, and the saponification product removed is an azeotropic mixture of 2-ethylhexanol-(1) and water which is cooled to room temperature to form an organic phase and an aqueous phase.

7. Method as claimed in claim 6 wherein the two phases generated after cooling of the azeotropic mixture are separated from each other, the organic phase generated from the cooled azeotropic mixture consists mainly of 2-ethyl-hexanol-(1) and is burnt, and the aqueous phase generated from the cooled azeotropic mixture is recycled into the saponification process.

8. Method as claimed in claim 3 wherein the phosphoric acid ester in the waste liquid consists of a mixture of TBP and HDEHP and the mixture of TBP and HDEHP is contained in the lighter phase formed in step (g), the saponification is performed at a temperature in excess of 90° C, and the saponification product removed is a mixture of butanol, 2-ethyl-hexanol-(1) and water and is cooled to room temperature to form an organic phase and an aqueous phase.

9. Method as claimed in claim 8 wherein the two phases generated after cooling of the mixture of butanol, 2-ethyl-hexanol-(1) and water are separated from each other, the organic phase generated from the cooled azeotropic mixture consists essentially of butanol and 2-ethyl-hexanol-(1) and is taken to combustion, and the aqueous phase generated from the cooled azeotropic mixture is recycled into the saponification process.

10. Method as claimed in claim 2 wherein the excess of water used in step (g) corresponds to between two and five times the the volume of the heavier phase containing phosphoric acid and impurities.

11. Method as claimed in claim 2 wherein the base used for saponification is approximately 50% caustic soda solution.

12. Method as claimed in claim 1 wherein the washing solution of step (c) has a pH of 10 to 11.

13. Method as claimed in claim 2 wherein at least the heavier phase formed in step (g) and containing diluted phosphoric acid and residual fraction of radioactive impurity is taken to a waste water decontamination system and from there to solidification with bitumen.

14. The method as defined in claim 13 wherein the used washing solution of step (c) is separated from the washed lighter phase and is taken to a waste water decontamination system and from there to solidification with bitumen or cement.

15. The method as defined in claim 1 wherein the waste liquid contains at least one impurity of the group of (1) radioactive materials, (2) decomposition and/or hydrolysis products of phosphoric acid esters, (3) nitric acid esters, (4) nitrous acid esters, (5) nitro-compounds and (6) complex compounds of at least one of these compounds with ruthenium, zirconium, niobium, uranium or plutonium.

16. The method as defined in claim 3 wherein the removal of the azeotropic mixture from the saponified lighter phrase leaves behind a residue; the residue is cooled after completion of the saponification; the cooled residue is diluted; and the diluted and cooled residue is taken to solidification with bitumen.

17. The method as defined in claim 14 wherein one saponification product is an azeotropic mixture which is removed from the saponified lighter phase to leave behind a residue; the residue is cooled after completion of the saponification; the cooled residue is diluted; and the diluted and cooled residue is taken to solidification with bitumen.

18. The method as defined in claim 1 wherein said decontamination factor is about $10^6$.

19. Method of preparing a waste liquid for non-polluting storage and recovering a useful component from the waste liquid, the waste liquid containing a solution of phosphoric acid ester and hydrocarbon used in the reprocessing of spent nuclear fissile and/or fertile materials and further containing at least one impurity in the form of radioactive materials or decomposition products, comprising:

a. adding a 50% caustic soda solution to the waste liquid in a quantity corresponding to a molar ratio of NaOH to phosphoric acid ester of 3:1, relative to the phosphoric acid ester content of the waste liquid, to form a saponified waste liquid containing an azeotropic mixture;
b. removing the azeotropic mixture from the remainder of the saponified waste liquid during the saponification process to form a reaction mixture;
c. cooling the reaction mixture after completion of the saponification;
d. diluting the cooled reaction mixture with water to form an organic phase containing hydrocarbon and an aqueous phase containing phosphate and impurity;
e. separating the organic phase containing hydrocarbon from the aqueous phase containing phosphate and impurity;
f. washing the separating organic phase of step (e) containing hydrocarbon with concentrated phosphoric acid to purify it and obtain a washed and separated organic phase with a decontamination factor of about $10^5$ to $10^6$ with respect to the waste liquid of step (a);
g. recycling the purified hydrocarbon of step (f) by adding phosphoric acid ester to the hydrocarbon to form a fresh solution of hydrocarbon and phosphoric acid to be used in the reprocessing; and
h. treating the separated aqueous phase of step (e) containing phosphate and impurity to form a solidified waste product containing radioactive material.

20. Method as defined in claim 19 wherein the azeotropic mixture is continuously removed during the saponification and the removed azeotropic mixture is recondensed and cooled to form an organic phase and an aqueous phase.

21. Method as claimed in claim 20 wherein the phosphoric acid ester in the waste liquor is TBP, the azeotropic mixture removed is a mixture of butanol and water, the two phases generated during cooling of the azeotropic mixture are separated from each other, the separated organic phase of the azeotropic mixture consists mainly of butanol and is burnt, and the separated aqueous phase of the azeotropic mixture is returned to the saponification process.

22. Method as claimed in claim 20 wherein the phosphoric acid ester in the waste liquid in HDEHP, the azeotropic mixture removed is a mixture of 2-ethylhexanol-(1) and water, the two phases generated during cooling of the azeotropic mixture are separated from each other, the separated organic phase consists mainly of 2-ethyl-hexanol-(1) and is burnt, and the separated aqueous phase of the azeotropic mixture is returned to the saponification process.

23. Method as claimed in claim 20 wherein the phosphoric acid ester in the waste liquor is a mixture of TBP and hdehp, the azeotropic mixture that is removed is a mixture of butanol, 2-ethyl-hexanol-(1) and water, the two phases generated during cooling of the azeotropic mixture are separated from each other, the separated organic phase of the azeotropic mixture consists mainly of butanol and 2-ethyl-hexanol-(1) and is burnt, and the separated aqueous phase of the azeotropic mixture is returned to the saponification process.

24. Method as claimed in claim 19 wherein at least the separated aqueous phase formed in step (e) containing impurity and phosphate is taken to solidification with bitumen.

25. Method as defined in claim 24 wherein the washing step (f) forms an organic phase containing hydrocarbon and an aqueous phase containing phosphoric acid, the aqueous phase containing phosphoric acid is separated from the organic phase containing hydrocarbon and is then taken to a waste water decontamination system and from there to solidification with bitumen or cement.

26. The method as defined in claim 19 wherein the waste liquid contains at least one impurity of the group of (1) radioactive materials, (2) decomposition and/or hydrolysis products of phosphoric acid esters, (3) nitric acid esters, (4) nitrous acid esters, (5) nitro-compounds and (6) complex compounds of at least one of these compounds with ruthenium, zirconium, niobium, uranium or plutonium.

27. The method as defined in claim 19 wherein said decontamination factor is about $10^6$.

* * * * *